United States Patent [19]

Herrera

[11] Patent Number: 4,621,865

[45] Date of Patent: Nov. 11, 1986

[54] DEMOUNTABLE PATIO FURNITURE

[76] Inventor: Fernando Q. Herrera, 1118 Porter St., San Antonio, Tex. 78210

[21] Appl. No.: 640,746

[22] Filed: Aug. 14, 1984

[51] Int. Cl.[4] ..... A47B 39/00; A47B 37/04

[52] U.S. Cl. ..... 297/157; 297/184; 297/440

[58] Field of Search ..... 297/157, 440, 184, 445; 211/182; 403/377, 327, 375, 361; 256/DIG. 5, DIG. 6

[56] References Cited

U.S. PATENT DOCUMENTS

| | | | |
|---|---|---|---|
| 1,941,652 | 1/1934 | Bellavia | 297/184 |
| 2,362,567 | 11/1944 | LaRue | 297/157 X |
| 2,511,452 | 6/1950 | Anderson et al. | 297/184 X |
| 3,100,127 | 8/1963 | Barto | 297/157 |
| 3,574,393 | 4/1971 | Hughes | 297/157 |
| 3,860,350 | 1/1975 | Rogers | 403/377 X |
| 3,977,528 | 8/1976 | Berger | 211/182 |
| 4,304,436 | 12/1981 | Rowland | 297/445 |
| 4,330,151 | 5/1982 | Healey | 297/157 |
| 4,349,213 | 9/1982 | Hirsch | 211/182 X |

FOREIGN PATENT DOCUMENTS

| | | | |
|---|---|---|---|
| 202310 | 8/1958 | Austria | 297/157 |
| 1112861 | 9/1954 | France | 297/157 |
| 2437809 | 6/1980 | France | 297/440 |

*Primary Examiner*—Peter A. Aschenbrenner
*Attorney, Agent, or Firm*—Richard C. Litman

[57] ABSTRACT

An improved form of patio furniture comprising a demountable assembly of interlocking end frames, seats, seat backs, table, canopy posts, and cross-bracing. The resultant assembly is stable and rigid in three dimensions and can be assembled or disassembled without the use of tools. The disassembled elements are essentially two dimensional and can be laid into a shallow box or container suitable for transport by automobile to picnic or beach areas.

5 Claims, 14 Drawing Figures

Fig. 1
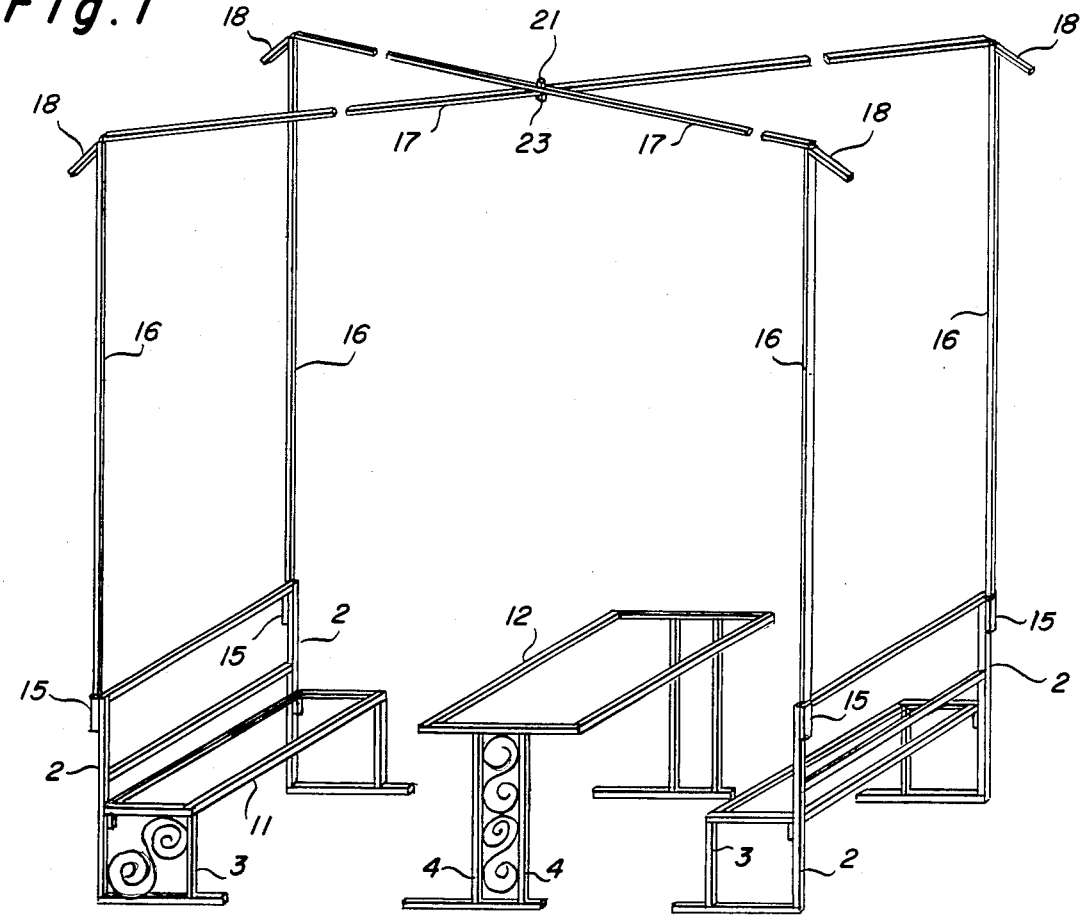
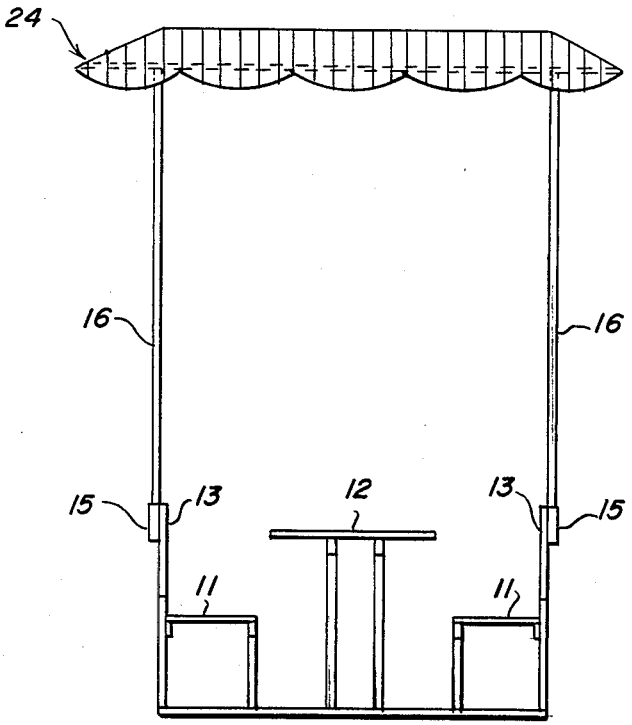
Fig. 2

DEMOUNTABLE PATIO FURNITURE

BACKGROUND OF THE INVENTION

This invention relates to an improved form of patio furniture which has structural strength and durability comparable to other commercially available patio furniture, but has the further advantage and convenience of being completely demountable and transportable to any location where picnic facilities would be desirable.

Commercially available patio furniture is often sold in kit form and is supplied with an assortment of nuts, bolts, and fittings in order to complete the assembly, which assembly then becomes confined to the area wherein it was erected due to the weight and bulk of the assembled article.

The present invention can be sold as a kit in a shallow container, and can be erected by one person in just a few minutes without the use of tools. The elements of the assembly can be easily disassembled, thus making it convenient to transport the kit to any location where picnic facilities are desired.

The assembly is sufficiently durable to remain permanently outdoors. The kit can be supplied with a detachable fabric canopy which can be decoratively colored and styled.

The components of the kit can be manufactured of varying grades and gauges of metal material such that the basic kit can be marketed in sizes ranging from children's backyard play furniture to larger units which are appropriate for use in commercial restaurants or municipal parks.

BRIEF DESCRIPTION OF THE DRAWINGS

The features and objects of the invention will be better understood by referring to the accompanying drawings in which:

FIG. 1 is an exploded isometric view of the complete assembly;

FIG. 2 is a side view of the assembly showing the segmented feature of the seats, table, and other elements, and further showing a representation of a fabric canopy;

SUMMARY OF THE INVENTION

Figure 2A:
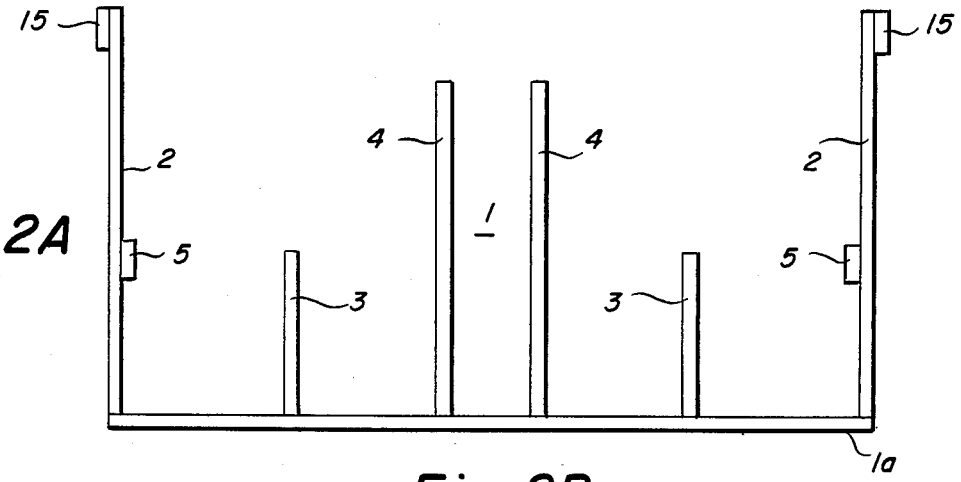
FIG. 2*a* is a side view of an end frame showing upright posts and sockets.

This invention is an improved form of patio furniture comprising modular table, seating, and canopy structures. The entire assembly is demountable and therefore portable because the various elements are manufactured separately and may be assembled without the use of any tools by the interconnection of male/female fittings on the frame, table, seats, seat backs, and canopy.

Each element of the assembly is fashioned so that it will lie flat when stored (containerized) and will then further interconnect and interlock when the elements are assembled. The finished assembly is stable and rigid in 3 dimensions.

The assembly comprises:

1. End frames which are composed of co-planer upright supports for the seats, seat backs, and table top, said supports being permanently attached to a horizontal runner.

2. A table top, seat bottoms, and seat backs manufactured as individual pieces and equipped with downwardly extending posts and keys which can be nested into the tops of the aforesaid upright supports.

3. Canopy posts which nest into metal sockets on the back or outside of the aforesaid seat back supports.

4. A canopy frame consisting of cross braces with turned down hooks which fit into holes in the tops of said canopy posts.

Each of the elements of the assembly can be manufactured of light weight metal suitable for painting, resulting in an assemblage that is both decorative and functional (structural). When disassembled, the pieces can be placed into a shallow container that is light enough in weight to be handled by hand and small enough to be transported on the roof-top rack of an automobile for use at the beach, picnic, etc.

DESCRIPTION OF THE PREFERRED EMBODIMENT

An improved form of patio furniture comprising a demountable assembly of seats, table, and canopy, constructed in accordance with the present invention is shown in FIGS. 1–9. FIG. 2*a* illustrates an end frame 1 comprising coplaner upright hollow metal supports 2, 3, and 4, said supports being permanently attached to a horizontal runner 1*a*. Two such end frames comprise a support structure onto which seats 6, table top 7, and seat backs 10 fit in an interlocking manner so that the basic seat and table structure is stabilized and rigid in three dimensions. The end frames are preferably constructed of stock tubular steel or aluminum materials of rectangular cross section, and of sufficient section modulus to withstand the torsion and bending moments which occur as a result of normal loads on the assembly.

Figure 2B:
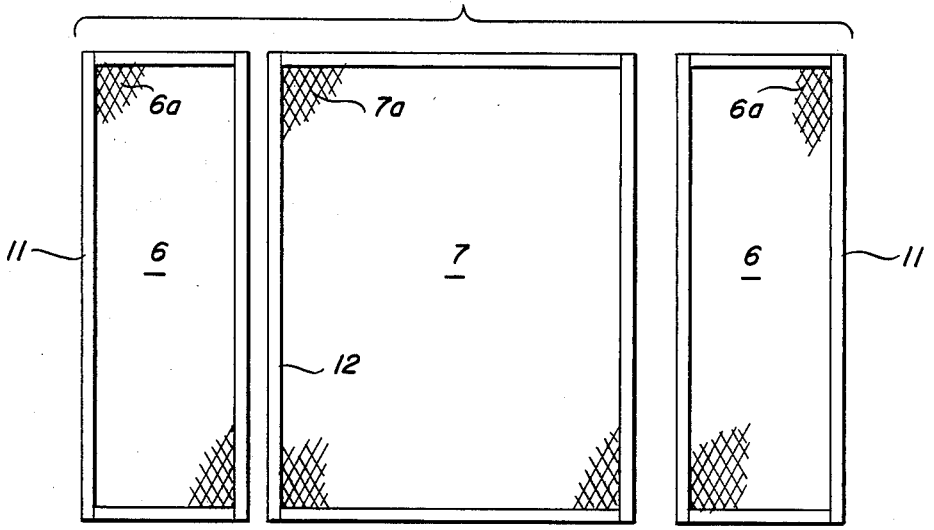
FIG. 2*b* is a plan view of the seats and table top.

FIG. 2*b* illustrates seats 6 consisting of rectangular angle frames 11, and having surfaces made of metal mesh material 6*a* permanently attached to the underside of the horizontal legs of said angles. The table top 7 is similarly constructed of a rectangular angle frame 12, and having a surface made of metal mesh material 7*a* permanently attached to the underside of the horizontal legs of said angles.

Figure 2C:
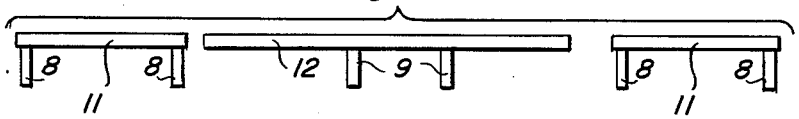
FIG. 2*c* is an end view of the seats and table top showing downwardly extending posts.

FIG. 2*c* shows downwardly extending posts 8 which are permanently attached to the inside corners of seat frame 11, and which nest into hollow metal sockets 5 and into the top of upright seat supports 13. The downwardly extending posts are tubular metal segments made of the same materials as the other framing elements, and are of suitably reduced rectangular cross section so as to fit or nest inside the appropriate sockets and posts. This figure also shows downwardly extending posts 9 which are permanently attached to the inside of the vertical legs of angle frame 12, said downwardly extending posts being positioned so as to nest into the tops of centermost hollow metal supports 4.

Figure 2D:
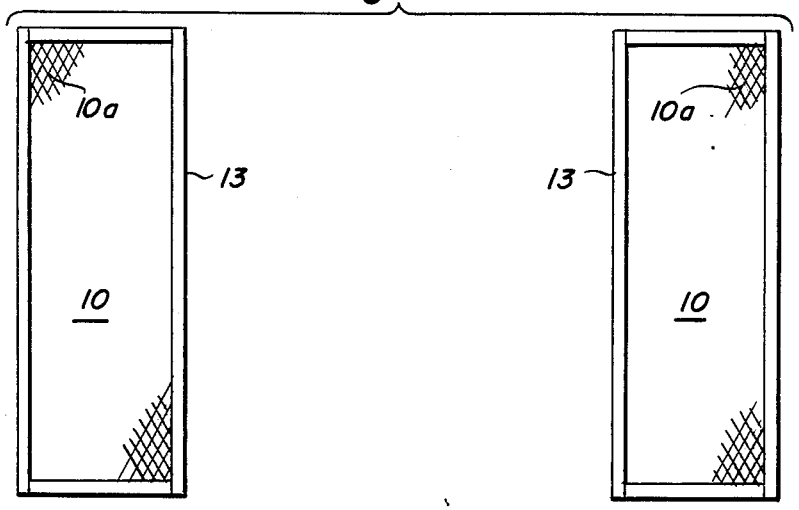
FIG. 2*d* is a plan view of the seat backs.

FIG. 2*d* shows a plan view of the seat backs 10 consisting of rectangular angle frames 13, and having a surface made of metal mesh material 10*a* permanently attached to the back side of the vertical legs of said angles.

Figure 3:
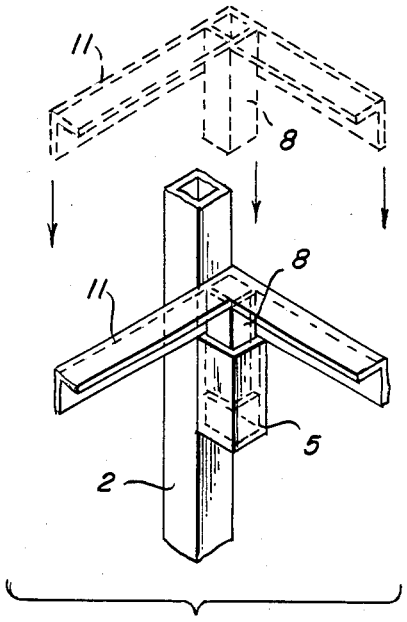
FIG. 3 is an isometric detail showing the manner in which a seat post nests into a support socket.
Figure 4:
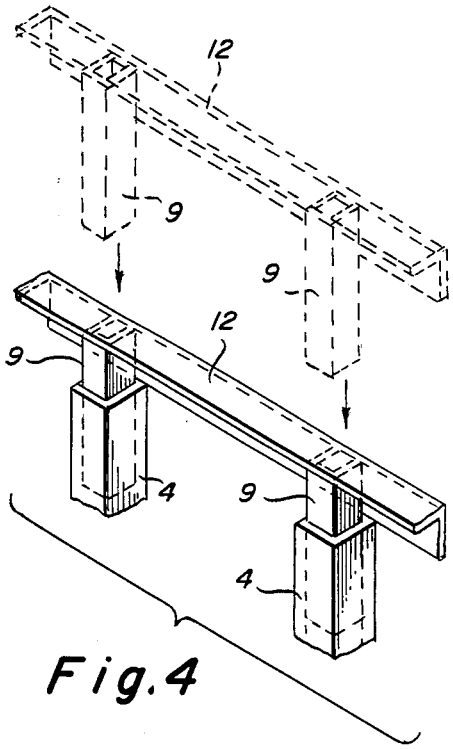
FIG. 4 shows the manner in which the table posts nest into the upright supports.

FIG. 3 is a detail view showing the manner in which downwardly extending posts 8 nest into hollow metal sockets 5, said sockets being permanently attached to seat back supports 2. FIG. 4 similarly shows the manner in which downwardly extending posts 9 nest into the tops of upright hollow metal table supports 4.

Figure 5A:
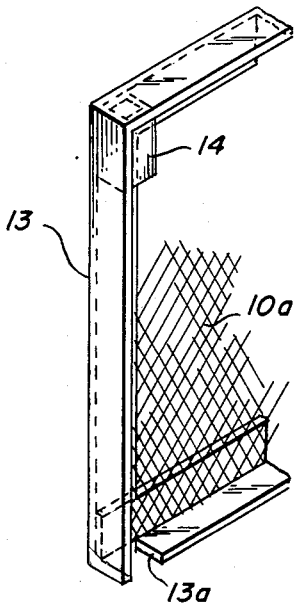
FIG. 5*a* is a detail of the seat back.
Figure 5B:
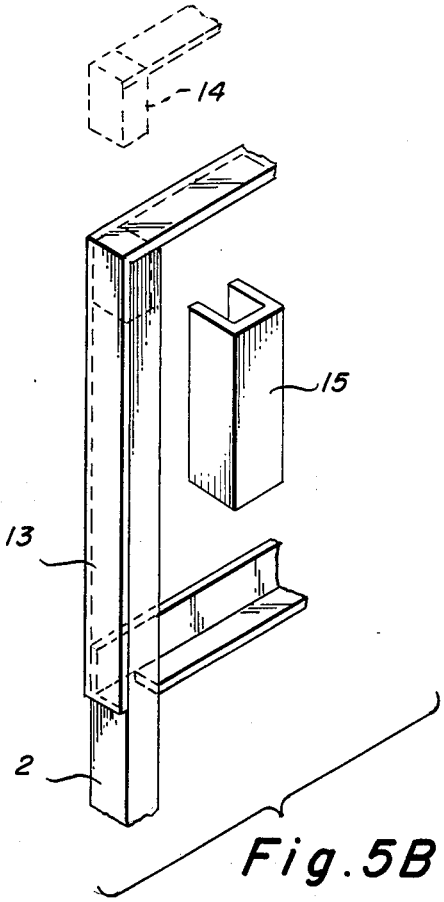
FIG. 5*b* is a detail showing the seat back in position on the support post.
Figure 6:
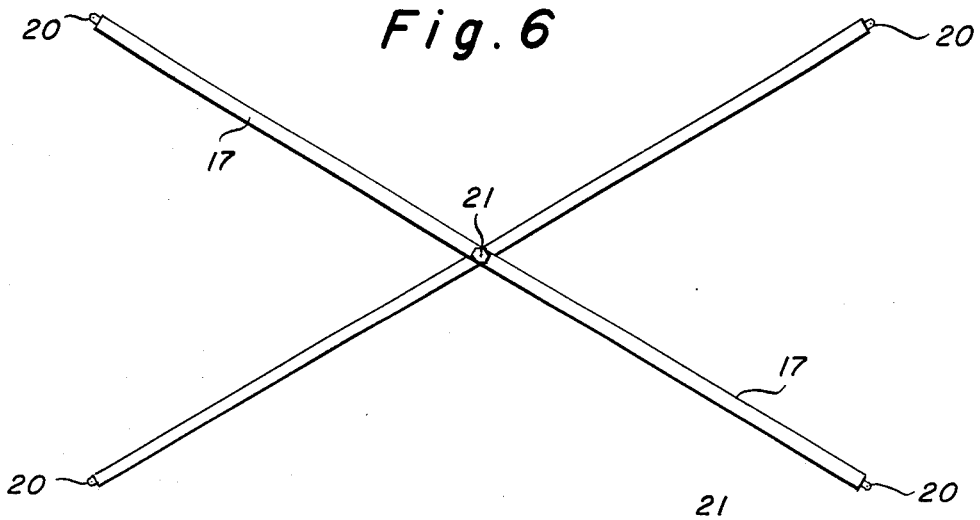
FIG. 6 is a plan view of the cross-bracing.
Figure 9:
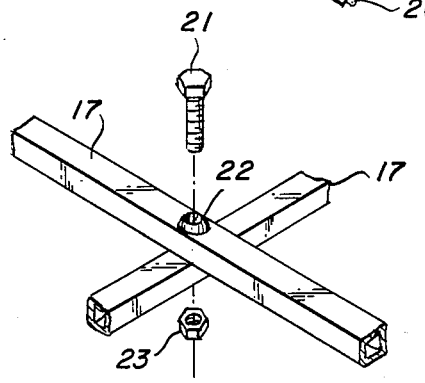
FIG. 9 is a detail view of the connection in the center of the cross-brace.
Figure 7:
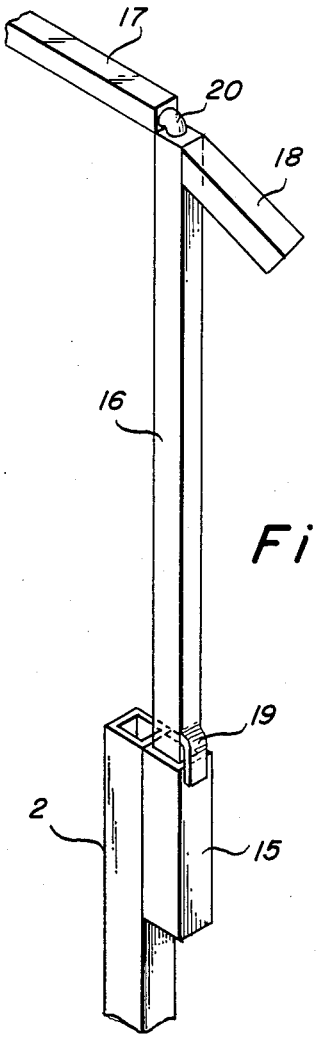
FIG. 7 is a detail of the corner assembly showing the canopy post and cross-brace connection.
Figure 8:
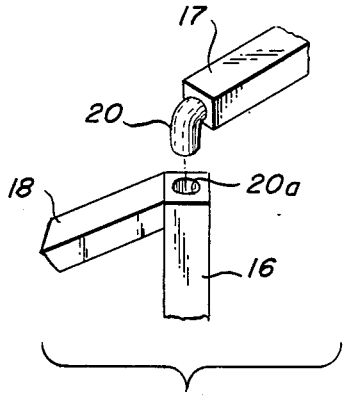
FIG. 8 is an exploded detail view showing the connection between the canopy post and cross-brace.

FIG. 5*a* is a detailed view of the back side of the seat back frame 13 showing key 14 which nests into the top of outermost hollow metal support 2, and further showing slot 13*a* in the horizontal leg of the bottom angle member, which slot permits angle frame 13 to fit flush against outermost upright support 2. Key 14, nested in the top of hollow metal support 2, operates to prevent rotation of the seat back, thereby maintaining said seat back in a vertical position and preventing displacement in all directions except for the vertical direction.

The nested arrangement of hollow metal elements of rectangular cross section operates to stabilize the individual connections against twisting and rotation. The resultant assembly of seats, seat backs, table, and end frames is a combination of planar elements at right angles to each other. Each element operates to lock, and each in turn is locked against translation and overturn by the adjacent elements. The seat, table, and seat back elements remain in place under their own weight and require no further locking or pinning means to prevent their dislocation during normal use.

FIGS. 6, 7, 8, and 9 show the details of the canopy support structure consisting of corner posts 16, cross-bracing 17, and downwardly inclined extensions 18. Corner post 16 is a tubular metal segment of sufficiently reduced rectangular cross section so as to fit or nest inside socket 15. Cross-bracing 17 consists of two segments of tubular metal, each metal segment being of sufficient length to span the distance from one corner post 16 to the diagonally opposed corner post 16. The cross pieces are connected at the midpoints by bolt 21. The assembly of the cross-braces can be performed by hand and without the use of any tools simply by inserting bolt 21 through the corresponding holes in the cross-brace pieces and hand tightening nut 23.

One common disadvantage of hinged or rotatable connections of this type is the binding of the various metal elements upon formation of any rust or corrosion, or upon overtightening of the bolt. The use of a tool is then required in order to break the connection loose. The problem is overcome in this invention by the use of conically shaped soft rubber gasket 22, said gasket being made of styrene-butadiene rubber or like material. The gasket permits the assembly to be joined snugly, but prevents the development of tension in the bolt which would cause the metal parts to bind or lock against each other.

Metal hooks 20 are permanently attached to the ends of cross pieces 17, said hooks fitting into holes 20*a* in the tops of each canopy post 16. The down turned portion of hook 20 can be made several inches in length so as to extend well inside canopy post 16. Any minor uplift which might then occur will not have the effect of dislocating the cross bracing and canopy. The entire assembly, including canopy frame, is thus cross-braced and and stable in three dimensions.

The use of downwardly inclined members 18 attached to the outside faces of posts 16 serves to support the outer edges or flaps of canopy 24 in a manner resembling that shown in FIG. 2. The downwardly inclined segments can be extended to any desired length to accommodate canopies of varying sizes. The use of permanently attached spring clips 19 operates to hold posts 16 in place and prevents the dislocation of the canopy assembly due to updrafts or gusts of wind.

The entire furniture assembly described above is mountable and demountable by hand without the use of any tools. All of the above recited elements are essentially two dimensional and can be laid into a box or container suitable for transport in a family vehicle such as a station wagon, or on a top mounted rack on most other automobiles.

I claim:

1. An easily assembled combination of a stable rectangular table having four corners and two rectangular seats, each seat having four corners and each seat being parallel in the lengthwise direction with the table, the combination having a single square or rectangular tubular horizontal support, a flat side of which engages the surface upon which the assembled combination is placed, for each lengthwise end of the table and the two rectangular seats, two coplaner upright hollow metal supports having a square or rectangular cross section integral with each horizontal support for supporting a table top and two coplaner upright hollow metal supports each having a square or rectangular cross section integral with each horizontal support for supporting each seat, said upright supports permanently attached to each horizontal support, hollow sockets each having a square or rectangular cross section positioned at seat height in each of the seat supports, seat attachment means consisting essentially of downward extending posts, each having a square or rectangular cross section, permanently attached to the corners of the seats which nest into the hollow metal sockets at seat height and table top attachment means consisting essentially of downward extending posts, each having a square or rectangular cross section, permanently attached to the corners of the table top, which posts nest tightly into the hollow metal supports at table height, the easily assembled combination being entirely free of bolts, screws or any other additional fastening means for the assembling or disassembing the combination other than the posts and sockets.

2. The combination table and seats of claim 1 wherein the seat attachment means is not adjustable and utilizes no fasteners other than the nesting.

3. The combination table and seats of claim 1 wherein the table top attachment means is not adjustable and utilizes no fasteners other than the nesting.

4. The stable table of claim 1, free of diagonal bracing.

5. The combination of table and seats of claim 1 further characterized by seat backs having downwardly extending four cornered posts and mating four cornered sockets in the upright seat supports.

* * * * *